United States Patent [19]

Cox

[11] 4,186,808

[45] Feb. 5, 1980

[54] EARTH BORING MACHINE WITH CRUSHING ROLLERS

[76] Inventor: Kenneth C. Cox, Blackburn Rd., R.D. #4, Sewickley, Pa. 15143

[21] Appl. No.: 811,033

[22] Filed: Jun. 29, 1977

[51] Int. Cl.[2] ..... E21B 9/22

[52] U.S. Cl. ..... 175/334; 175/102; 175/213; 175/333

[58] Field of Search ..... 175/331, 332, 333, 334, 175/336, 385, 339, 340, 313, 324, 102, 213; 299/81, 86, 90

[56] References Cited

U.S. PATENT DOCUMENTS

| | | | |
|---|---|---|---|
| 3,285,355 | 11/1966 | Neilson et al. | 175/334 |
| 3,292,719 | 12/1966 | Schumacher, Jr. | 175/339 |
| 3,360,061 | 12/1967 | Canalizo | 175/324 |
| 3,379,264 | 4/1968 | Cox | 175/334 X |
| 3,384,191 | 5/1968 | Schumacher, Jr. et al. | 175/340 |
| 3,511,539 | 5/1970 | Schonfeld | 299/90 X |

FOREIGN PATENT DOCUMENTS

| | | | |
|---|---|---|---|
| 801615 | 9/1958 | United Kingdom | 175/102 |

*Primary Examiner*—Ernest R. Purser

*Assistant Examiner*—Nick A. Nichols, Jr.

*Attorney, Agent, or Firm*—Parmelee, Miller, Welsh & Kratz

[57] ABSTRACT

An earth boring machine with a rotating cutter head having a multiple of individual cutters positioned at different distances from the center of rotation and angularly spaced from one another on the cutter head while the cutter head itself is shaped to direct the cuttings into a collecting area, which may be under the center of the rotary head or which may be concentric about the center area, has elevator means, which may be mechanical, hydraulic or pneumatic, to remove the cuttings from the collection area, and has one or more crushing rollers thereon arranged to crush cuttings which are too large for effective removal by the elevator means into small chips or fragments together with barrier means for restraining such oversize pieces in the path of the crushing roll or rollers so as to prevent their entry into the collection area until they have been adequately crushed. The barrier means so provided are arranged to permit the smaller fragments and chips to move into the collection area with little impedance.

7 Claims, 7 Drawing Figures

FIG. 2
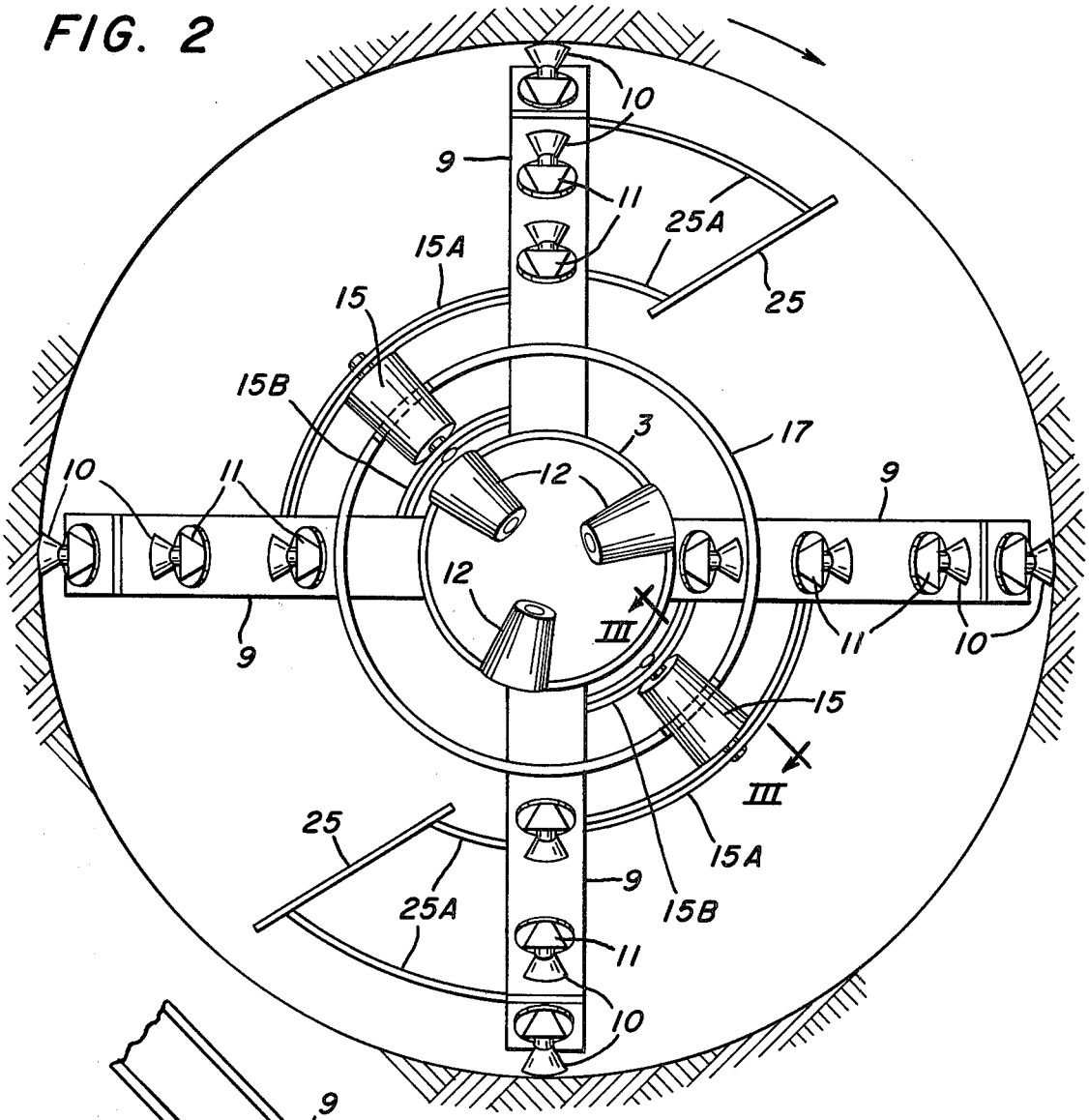
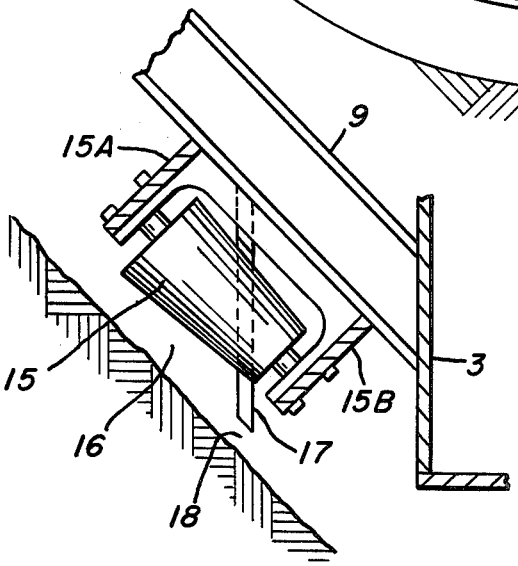
FIG. 3

EARTH BORING MACHINE WITH CRUSHING ROLLERS

This invention relates to earth boring machines designed to bore a vertically extending shaft into the earth where the borings and cuttings are removed vertically from the shaft, as contrasted to tunnels or generally horizontal earth penetrations, disclosed for example in my U.S. Pat. No. 3,379,264 dated Apr. 23, 1968. More particularly, this invention is for a boring machine of the general type disclosed in said patent wherein rock fragments and chunks will be crushed to a size to be effectively removed from the bore before they are in a position to by engaged by the elevator means by which the detritus is carried to the surface and discharged.

Various arrangements have been devised for removing rock fragments and other detritus from the shaft as boring progresses, among which are endless bucket chains, pneumatic, vacuum or hydraulic conveyors and screw lifts. The disadvantage is that while cutters can be arranged to cut the rock into large fragments, especially in some formations, many of the resulting chunks and pieces and too large for removal by such elevator means. There is, therefore, an anomalous condition in that the more efficient and rapid the cutting by the removal of large pieces, the greater is the difficulty of removing the detritus due to the difficulty of removing such large fragments and their accumulation in the bore to block even the entrance of smaller fragments into the elevator means.

The present invention contemplates an arrangement wherein the cutter head is provided not only with cutters but also with crushing rollers along with barrier means which restrain the passage of rock fragments from reaching the elevator means until they have been reduced by operation of the crushing rollers to sizes where the elevator means can effectively convey them out of the bore. To this end, the rotating cutter head has a barrier effectively interposed between the cutters, or most of them, and the elevator means to retain lumps and chunks of rock or borings above a predetermined size in the path of the crushing rolls until they have been reduced to a maximum size small enough to enable them to be removed by the elevator.

My invention may be more fully understood by reference to the accompanying drawings, in which:

FIG. 2 is a somewhat schematic plan view, looking upward at the underface of the boring head with the central suction tube and its offset end being omitted for clarity of illustration.

FIG. 3 is a fragmentary section in the plane of line III—III of FIG. 2 showing the barrier and crushing roll;

Figure 1:
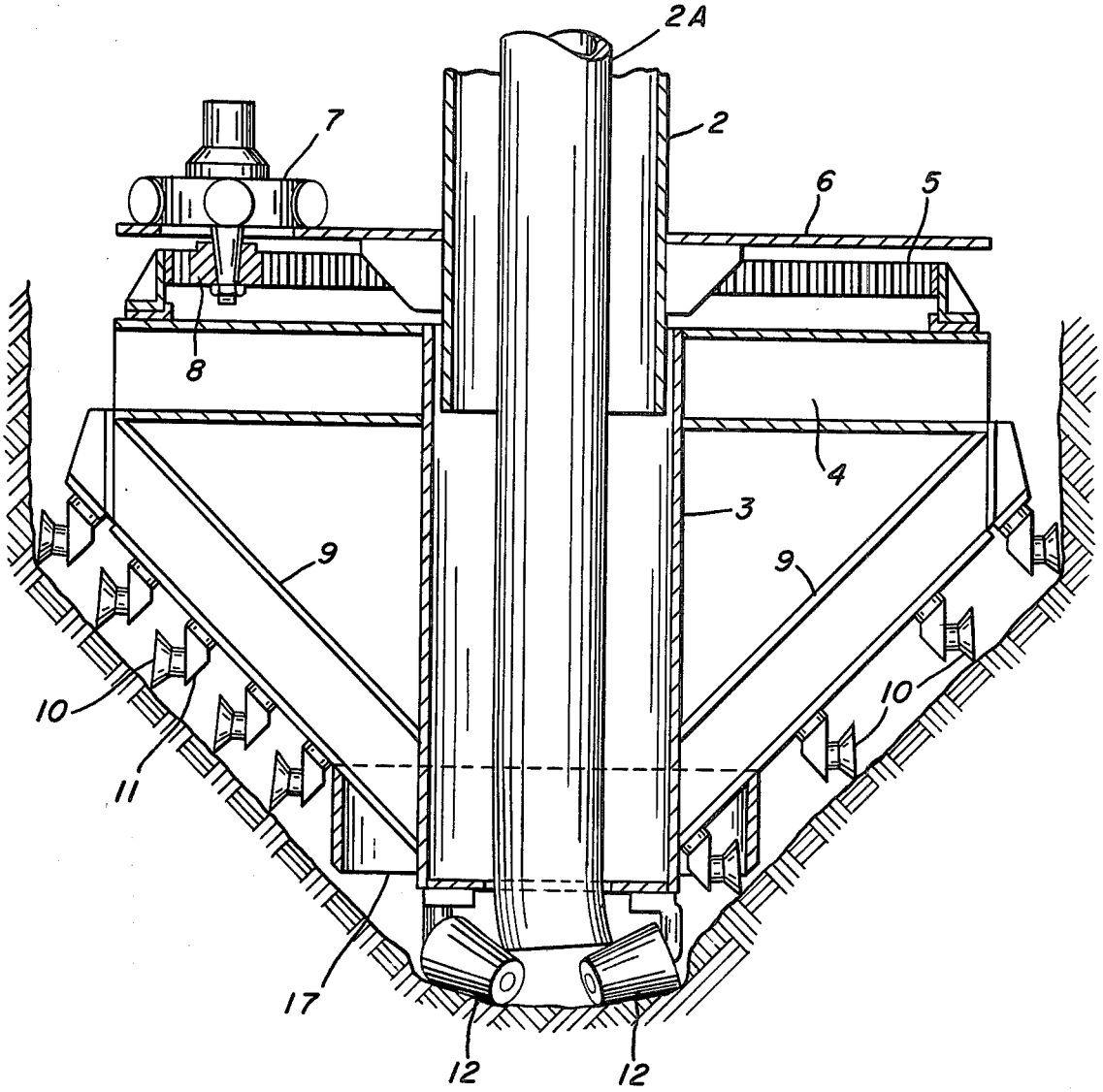
FIG. 1 is a more or less schematic vertical section through a rotary cutting head embodying the invention.
Figure 4:
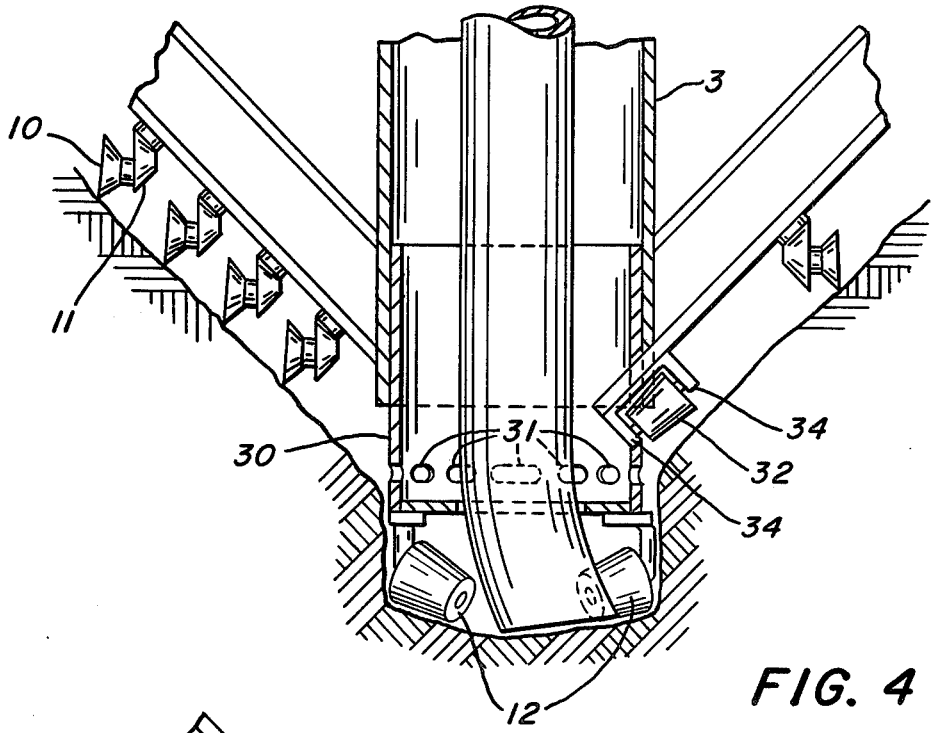
Figure 5:
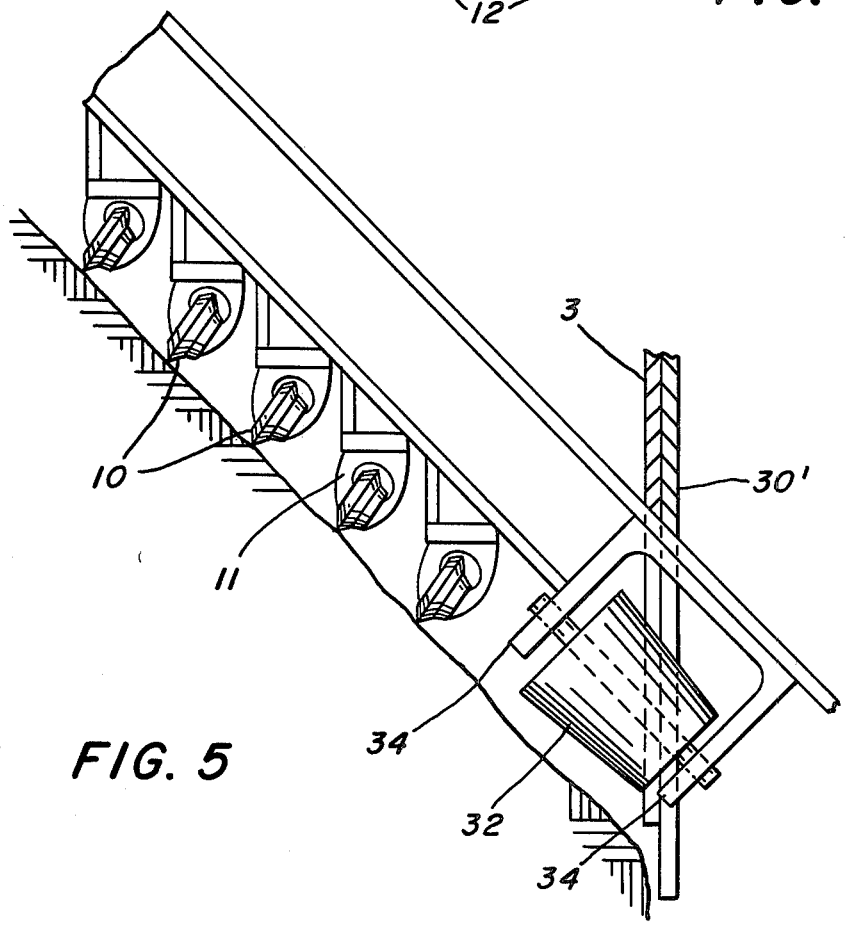
Figure 6:
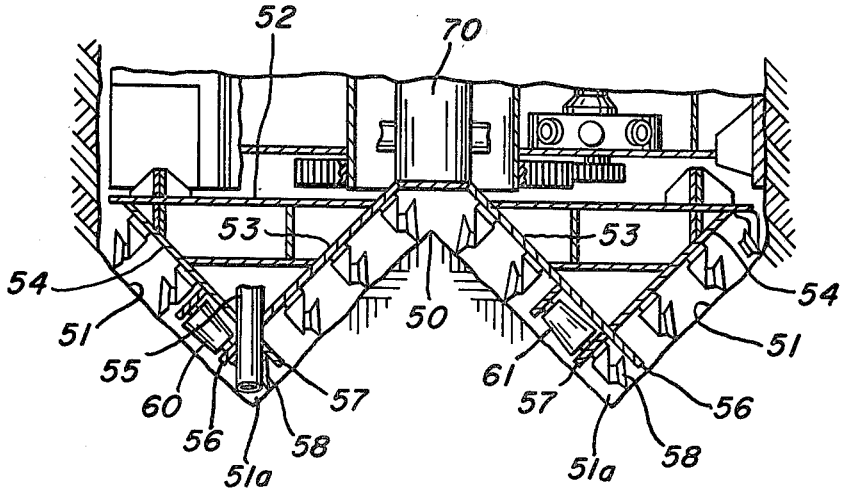
Figure 7:
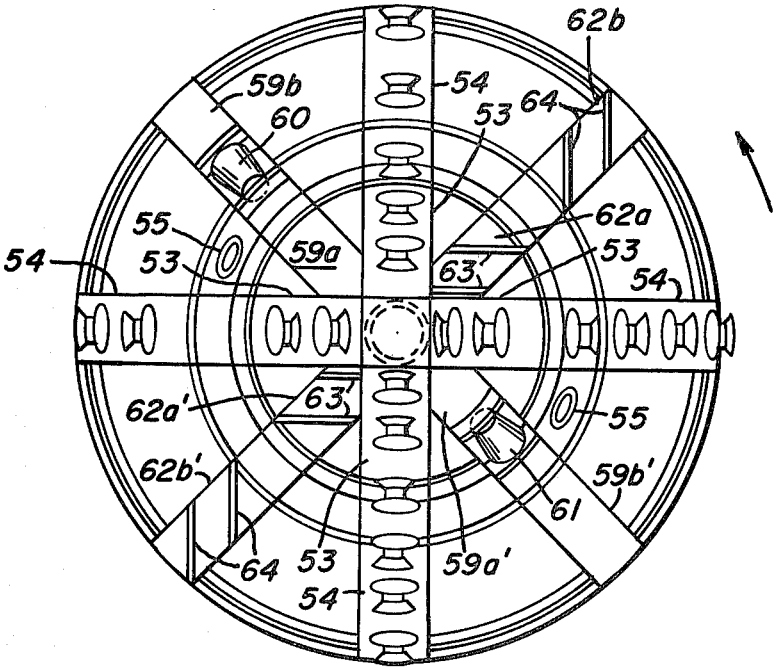

FIG. 4 is a view generally similar to FIGS. 1 and 2 but wherein the barrier is a cylinder at the ends of the sloping strut and tube assembly and which extends below the sloping bottom of the bore into the central lead opening. The cylinder, as here shown, has holes therethrough which allow small pieces and fragments to drop through the barrier into the collection area while large lumps are confined against the barrier until they have been crushed by rolls;

FIG. 5 is a fragmentary view showing one of the struts of FIG. 1 in side elevation with differently inclined barrier and with the crusher roll, for purposes of illustration, trailing directly behind this strut, whereas actually the crusher roll is positioned around an arc from the position shown due to the circular path in which these elements move, as in FIGS. 2 and 3;

FIG. 6 represents somewhat schematically a vertical section through another form of cutter head arranged to form the bottom of the bore with a central cone extending part way toward the rim of the bore and an opposed surface sloping downwardly and inwardly toward the first, producing what appears in the section as having a letter W contour; and FIG. 7 is a bottom plan view of the cutter head shown in FIG. 6.

Boring machines of the type to which the present invention relates are known in the art, and such a machine is disclosed in my U.S. Pat. No. 3,379,264 of Apr. 23, 1968, the applicable disclosures of which are incorporated herein by reference.

In the boring machine shown in FIGS. 1 to 3 of the drawings, there is a central column assembly 2 which is splined for vertical movement in a normally stationary platform, as shown and explained in my said patent, but only the lower end of said column is here shown. There is a rotatable sleeve 3 surrounding the lower end of the column 2, and this sleeve has a laterally extending platform 4 at its upper end. There is an annular internal ring gear 5 on this platform concentric about the axis of the column assembly 2. There is a deck structure 6 slidably but nonrotatably fixed about the column 2 above the rotatable platform which may move up and down with the platform. There is a driving motor 7, here schematically indicated as an hydraulic or fluid pressure motor but which might well be an electric motor, supported on this deck structure with a pinion 8 that meshes with the ring gear 5 so as to rotate the platform 4 and the sleeve 3. Diagonal struts 9 extend from the periphery of the platform, to which they are attached, to the lower end of the sleeve 3. Disk cutters 10 are here shown, each with its own rigid bearing mount 11, and are secured at spaced intervals along the struts from the inner end toward the outer one, as more fully explained in my patent above referred to. The cutter disks thus move in concentric circles about the axis of the tubular column. Other well known cutter elements may, however, be used in place of all or part of the disks, as here shown.

There are other cutters schematically indicated at 12 carried on the lower end of the sleeve 3 designed to roll on the area below the sleeve as the sleeve rotates and keep the end of the sleeve spaced above the center of the bore and to cut away the center as rotary drilling of the bore progresses, thereby forming a central lead opening and collecting area toward which cuttings, chips and cutting debris gravitate or are moved with scrapers from the sloping surrounding bottom of the bore. A suction fan, as diagramed in FIG. 4 of my patent, sweeps the cuttings up the interior of the tubular column 2A to be discharged into an expansion chamber from which they are emptied into a skip bucket for removal while a duct leading to a suction fan on the surface moves the air, with perhaps some dust but generally free of its burden of cuttings, to a place of discharge at the surface, as explained in my said patent but to which this invention is not exclusively limited.

So much of the structure as has been described is known, but a description of it is important to the understanding of the present invention. In lieu of a fluid conveying system, such as an air or pneumatic system for removing the cuttings, often referred to as muck, an endless chain type of bucket conveyor or a screw-type lift may be used in machines of this general type and could be used with the particular machine here shown.

With the machine as shown in FIGS. 1 to 3, the bottom of the hole slopes at a relatively steep angle from the periphery of the bore toward the central collecting area of the bore so that rock fragments, chips and pieces slide down into this central area. Depending on the rock formation, the style of cutters and the weight or downward pressure applied to the cutting head, the rock fragments will vary in size, but for speed of cutting, the larger the fragments, the better, except for the fact that the larger fragments present removal difficulties.

In FIGS. 1 to 3 crushing rollers 15 are rigidly mounted in the boring head, two of them being here shown. Each is of truncated cone shape with the large end facing outwardly from the center and the undersurface being generally parallel with the slope of the bore but spaced a predetermined distance upwardly from the general slope of the bore which, in practice, is not a smooth surface as shown. This space between the roller and the surface is designated 16 (see FIG. 3) so that large fragments are broken into pieces without pulverizing smaller chips and fragments. As shown in FIG. 2, these rollers are rotatably supported in rigid arcuate bars 15A and 15B carried at their opposite ends on the two nearest struts 9.

There is a circular barrier or fence 17 fixed on the underside of the four struts extending downwardly close or closer to the slope of the bottom of the bore than between the roller and said bottom of the bore (see FIG. 3). The barrier is cut away to arch over the crushing rollers 15, so that as seen in FIG. 3 a longer portion of the lower surface of each roll 15 is uphill from the barrier, but in some cases, the crushing rolls may be entirely outside the barrier. The lower edge of the barrier is spaced a distance 18 above the slope of the bore about the same as the clearance space 16 between the lowermost periphery of the rollers and the bottom slope of the bore. With this annular barrier so arranged, chips or fragments that are no thicker than the distance 18 can slide or be moved under the barrier into the central collecting area of the bore, but thicker pieces will be retained against the barrier in the path of the crushing rollers to be crushed to a size where the resulting fragments will pass under the barrier and so be small enough for removal by whatever conveyor system is employed.

The crushing rollers are here shown to have smooth surfaces because of the reduced dimension of the drawing, but often they may be toothed or ribbed.

Also, as shown in FIG. 2, plow or scraper elements may be secured to the undersurface of the rotating cutter head so that where the slope of the bore or the cutter is not steep enough to assure the movement of the fragments and chips toward the center, the rotation of the cutter head with such plows will mechanically effect the inward crowding of the fragments or muck toward and into the path of the crushing rollers. These plows may take diverse forms, but as shown here, they simply comprise nonradial straight scraper blades 25 on the undersurface of the boring head angled with respect to the direction of rotation of the boring head, indicated by arrows, in a manner to effect the progressive travel of the cuttings toward and into the path of the crushing rollers. Their lower edges, of course, are close to the surface of the slope and they may be of heavy rubber or like resilient or flexible medium that may bear against the slope at the bottom of the bore to effect the movement of even small particles and cuttings toward the central area of the bore. They are here shown in FIG. 2 supported on brace bars 25A extending forwardly from two diametrically opposite struts 9 about 90° ahead of crushing roll 15, where they will not jam fragments too close into the paths of the following crushing rolls.

In the modification shown in FIG. 4, the barrier is a tubular sleeve 30 at the lower end of the column 3. In this instance, however, the barrier extends into a central lead opening below the outwardly and upwardly sloping bottom walls of the bore, and instead of the lower edge of the barrier keeping large pieces from passing beneath it, there is an annular series of openings 31 through the barrier at a level about even with the inner edge of the sloping bottom surrounding the barrier. Pieces of rock too large to pass through the openings are thus retained in the paths of the crushing rollers to be thereby broken into fragments that will pass through the openings 31. This has an advantage in that the width, as well as the thickness, of the fragments is metered, so to speak, to exclude for example thin, wide, flat fragments. As shown in FIG. 5, a similar result may be obtained by terminating the sleeve 30 a short distance above the lower edge of the slope of the bore in place of providing individual openings 31.

In FIG. 4 the crushing rollers 32 revolve with the boring head outside the sleeve 30. They are supported as in FIGS. 1 and 2 by parallel arcuate bars 34 which, as in FIGS. 1 and 2, have their ends welded to two adjacent struts so that, as in FIG. 2, the crushing rolls are located between two struts, one diametrically opposite the other. So-called "saddle bearing" supports carry the rollers 32 on the bars 34.

In some cases the cutter head may be arranged to so form the bottom of the bore as to resemble in cross-section a letter W, as shown in FIGS. 6 and 7. As so formed, the bore has a central cone portion 50 sloping downwardly and outwardly and a peripheral bottom wall 51 sloping downwardly and inwardly, the two forming between them a trough 51*a*. The boring machine of the general construction described in this case has a platform structure 52. There are four equally spaced struts 53 extending downwardly and outwardly from the center of this platform. They are joined to the ends, respectively, of four equally spaced downwardly and inwardly sloping struts 54, with the two diametrically opposite pairs of struts forming the W shape hereinbefore mentioned. Each strut assembly, comprising struts 53–54, has spaced cutters therealong, as described in my above-enumerated patent.

With a structure such as this where the boring head is used in digging a vertical shaft, the cuttings gravitate into the annular groove 51*a* surrounding the base of the central cone, this groove constituting the fragment collecting area. There are, therefore, one or more suction tubes 55 to remove the cuttings from the groove 51*a* and dispose of them as described in my aforesaid patent.

The lower ends of the downwardly and outwardly sloping struts 53 have a circular metal band 56 welded to these ends, the lower ends of which terminate a predetermined distance above the downwardly and outwardly sloping surface over which they are positioned to limit the size of fragments that can pass under its lower edge into the groove. There is a similar band or barrier 57 on the inner ends of the struts 54. Bottom cutter disks 58, oppositely arranged, as shown, are provided to cut the rock at the bottom of the groove formed between the two sloping surfaces.

Desirably, as here shown there are supplementary struts 59*a* and 59*b* between one pair of struts 53 and 54 and diametrically opposed similar pairs of supplementary struts 59*a'* and 59*b'*. Strut 59*b* has a crushing roller 60 thereon arranged to crush fragments which are too large to pass under the band or barrier 57, and the strut 59*a'* supports a crushing roller 61 arranged to crush fragments which are too large to pass under the band or barrier 57.

There may also be provided a second pair of supplementary struts 62*a* and 62*b* corresponding to 59*a* and 59*b* but removed 90° therefrom, and another similar pair of supplementary struts 62*a'* and 62*b'* diametrically opposite 62*a* and 62*b*. As shown, supplementary struts 62*a* and 62*a'* have scraper elements 63 so arranged with respect to the direction of rotation of the rotary head as to move the rock cuttings on the outwardly and downwardly sloping bottom of the bore outwardly toward the barrier 57 and the annular groove. The supplementary struts 62*b* and 62*b'* may have scraper elements 64 arranged to move material from the bottom surface of the bore inwardly toward the barrier 56 and the annular groove.

The suction tubes 55 will join a single axially extending central suction tube 70, corresponding to tube 2A in FIG. 1, through a connection, not shown for purposes of clarity, but which would include a swivel of a well-known type to allow the head to rotate relative to the tube 70.

I claim:

1. For use on an earth boring machine of the type where there is a rig with a rotating shaft, a boring head at the lower end of the shaft having cutters disposed around the undersurface of the head at various distances upwardly and outwardly between the center of the rotation of the boring head and the periphery thereof, the boring head and cutters being so arranged as to form and provide a collecting area in the bottom of the bore into which rock chips and fragments produced in the operation of the machine collect with the bottom of the bore around the collecting area sloping upwardly and outwardly from the collecting area toward the periphery of the bore at an angle to favor the descent of the fragments by gravity toward a barrier and collecting area and wherein elevator means is provided for removing the rock chips and fragments so produced and received in the collecting area, the invention comprising a boring head having:

(a) means arranged on the undersurface of the head comprising an annular barrier attached to the undersurface of the head effectively interposed between cutters in the collecting area and those cutters on the head outside the barrier for intercepting rock fragments moving down the sloping area around the barrier which are too large for removal thereof from said area by said elevator means while at the same time providing clearance for other cuttings and fragments to enter said area; and (b) crushing roller means with the peripheral surface thereof spaced above the surface of the bottom of the bore on the undersurface of the boring head arranged to crush said rock fragments which are so intercepted to a size where they can clear said barrier.

2. A boring head as defined in claim 1 in which the annular barrier extends from the undersurface of the cutter head toward the bottom of the bore but spaced clear of the bottom of the bore a distance sufficient to enable cuttings which are small enough to be effectively removed from the collecting area by the elevator means to pass between the lower edge of the barrier and the confronting bottom surface of the bore.

3. A boring head as defined in claim 1 in which the cutters which perform and provide the collecting area are arranged to form said area beneath the central area of the boring head and to countersink such area below the surrounding bottom of the bore, and the barrier is a hollow cylinder that extends into the countersink collecting area and which has annular series of openings therearound, each opening being of a size to exclude from the passage therethrough of rock fragments too large for discharge into the central area.

4. The boring head defined in claim 1 wherein the cutters are arranged to form said collecting area in the form of an annular trough between the periphery of the boring head but outwardly from the central area with other cutters being arranged to cut away the bottom of the bore from said annular trough outwardly to the periphery of the boring head and inwardly to the center of rotation of the boring head, there being at least two such annular barriers on the underside of the cutting boring head, one barrier being arranged to intercept the large fragments moving from the periphery inwardly toward the collecting area and the other being arranged to intercept the large fragments moving outwardly from the center to the collecting area.

5. The boring head defined in claim 1 in which the roller means comprises at least one crushing roll carried on the boring head in a position to describe a circular path when the boring head is rotating immediately over the bottom of the bore around said collecting area.

6. A boring head for use in earth boring operations designed to be rotated about a vertical axis, said boring head having cutters on the undersurface thereof at various positions around the head and at various distances between the center of rotation and the periphery of the boring head, some of said cutters being arranged to produce a common collecting area into which cuttings including rock fragments are discharged for removal from said area, an annular barrier means on the underside of the boring head arranged to exclude rock fragments or cuttings above a predetermined size from entering the collecting area but providing clearance for fragments and chips smaller than those of said predetermined size to enter said collecting area, and crushing means on the underside of the head arranged to travel with the rotation of the boring head in a circular path over the bottom close to the barrier means and reduce those fragments which are too large to clear the barrier means into smaller fragments that will clear the barrier means, wherein said head is so arranged that the collecting area is formed in the bottom of the bore as an annular groove located concentrically about the center of the bore with one area of the bottom sloping upwardly and inwardly from said collecting area and the portion of the bottom concentric about the outside of the collecting area sloping upwardly and outwardly, the cutter head and cutters being so arranged that both said sloping areas are pitched at an angle to favor the movement of fragments by gravity toward the barrier and collecting means, said barrier means comprising one element to restrain large fragments that descend the inner slope of the bottom and another element to restrain large fragments descending the outer slope of the bottom of the bore.

7. A boring head for use in earth boring operations designed to be rotated about a vertical axis, said boring head having cutters on the undersurface thereof at various positions around the head and at various distances between the center of rotation and the periphery of the boring head, some of said cutters being arranged to produce a common collecting area into which cuttings including rock fragments are discharged for removal from said area, a generally cylindrical barrier on the underside of the boring head disposed concentrically about the axis of rotation of the boring head and with its axis extending in a direction generally parallel with said axis of rotation and arranged to exclude rock fragments or cuttings above a predetermined size from entering the collecting area but providing clearance for fragments and chips smaller than those of said predetermined size to enter said collecting area, and crushing roller means of the underside of the head arranged to travel with the rotation of the boring head in a circular path over but spaced above the bottom of the bore and positioned adjacent to the barrier means and reduce those fragments which are too large to clear the barrier means into smaller fragments that will clear the barrier means.

* * * * *